United States Patent [19]

Frankland

[11] 4,127,794

[45] Nov. 28, 1978

[54] HIGH INTENSITY BAR GRAPH

[75] Inventor: Roger A. Frankland, Scottsdale, Ariz.

[73] Assignee: Beckman Instruments, Inc., Fullerton, Calif.

[21] Appl. No.: 844,002

[22] Filed: Oct. 20, 1977

[51] Int. Cl.[2] ..... H05B 37/00; H05B 39/00; H05B 41/00

[52] U.S. Cl. ..... 315/169 R; 315/169 TV

[58] Field of Search ..... 315/169 TV, 169 R; 340/324 M

[56] References Cited

U.S. PATENT DOCUMENTS

| | | | |
|---|---|---|---|
| 3,973,166 | 8/1976 | Maloney | 315/169 TV |
| 4,017,759 | 4/1977 | Miller | 315/169 TV X |

*Primary Examiner*—Alfred E. Smith
*Assistant Examiner*—Robert E. Wise
*Attorney, Agent, or Firm*—R. J. Steinmeyer; F. L. Mehlhoff; W. H. May

[57] ABSTRACT

A gas discharge display device for exhibiting an analog value in a sealed envelope having a viewing window with a plurality of linear cathode segments arranged in succession to form a row or column capable of exhibiting a glow discharge. The cathodes are arranged in groups within the sealed envelope with a separate anode electrode in operative relationship with each of the groups of cathodes. Alternate ones of the anode electrodes are activated simultaneously in alternating sequence, so that the time duration of cathode glow exhibited on each cathode segment is increased to provide a significant increase in the intensity of the bar graph display. The intensity of the bar graph may be decreased to accommodate a surrounding environment by reducing the on time for each cathode segment.

9 Claims, 5 Drawing Figures

HIGH INTENSITY BAR GRAPH

BACKGROUND OF THE INVENTION

This invention relates to gas discharge displays and, more particularly, relates to gas discharge display devices for exhibiting analog signals in a bar graph from wherein the intensity can be increased or decreased according to the desired conditions of the surrounding environment.

An example of a prior art gas discharge bar graph display is set forth in U.S. Pat. No. 3,973,166 issued Aug. 3, 1976 to Thomas C. Maloney. This patent shows the structure of the bar graph having a plurality of cathode electrodes with each being a linear segment arranged in succession along a substrate of a sealed envelope to form the column that is to exhibit glow discharge. A single anode is placed adjacent the entire series of cathode segments and the operation of the anode controls the height of the glow discharge along the column of cathode segments. U.S. Pat. No. 3,967,158 issued on June 29, 1976 to Richard A. Saxon discloses circuitry for operating a bar graph having the structure set forth in the above cited Maloney patent.

There are several disadvantages to the existing types of gas discharge display bar graphs. The primary disadvantage centers on the fact that these prior bar graphs do not have the ability to adjust the intensity of the glow discharge especially with respect to increasing the intensity to provide adequate contrast to a generally bright ambient environment. The most common example of such a situation is with respect to aircraft cockpit instrumentation where the aircraft operates in a range of varying conditions from direct sunlight to near total darkness. Obviously, when operating in direct sunlight it is necessary to have the intensity of the bar graph increased sufficiently to provide the satisfactory contrast, so that the magnitude of the bar graph can easily be detected by the pilot. The present technology limits the intensity of a gas discharge display to approximately 10,000 foot lamberts peak brightness. The ability to increase the intensity of the light cannot be accomplished by increasing the current, because the technical limits of the present art gas displays do not permit increased current to exceed the 10,000 foot lamberts intensity without sacrificing the life or integrity of the display.

In other situations where the aircraft is operating in total darkness, the brightness of the bar graph should be reduced considerably in accordance with the dark surroundings to avoid discomfort to the pilot's eyes. It is necessary to dim the cockpit instrumentation to eliminate the loss of so-called "night vision" of the pilot.

SUMMARY OF THE INVENTION

The present invention comprises a plurality of groups of cathode electrodes situated in succession along the substrate in a sealed envelope to form a column with a separate anode in operative relationship with each of the groups of cathodes. A reset cathode is situated adjacent the first cathode in each of the groups of cathodes, so that when a corresponding anode for that group of cathodes is activated, a glow discharge will propagate from the adjacent reset cathode along the cathodes within that group. The cathode electrodes are interconnected, preferably to three common circuits, while the anode electrodes are operated independently of each other. The anodes are operated in such a manner that corresponding cathodes within alternate groups of cathodes along the substrate will exhibit glow discharge simultaneously, so that the intensity of the bar graph can be increased. Therefore, the arrangement of the cathodes in a plurality of groups of cathodes with separate individual anode electrodes for each group of cathodes allows for the respective cathode segments to be energized to exhibit glow discharge for a longer period of time during the scanning cycle than if only one anode were used.

The present invention provides for the ability to increse the intensity of the bar graph to allow the display to be more compatible with high brightness ambient areas such as cockpit instrumentation when operating an aircraft in bright sunlight. The present high intensity bar graph would also be applicable for use in any outside environment with direct sunlight or where the surrounding light adjacent the instrument is bright.

Although the present invention is directed primarily to the ability to increase the light intensity of the bar graph display, the present invention can be dimmed in low light ambient conditions. The dimming of the bar graph is a function of the time that the bar graph is on and, therefore, by shortening the time in which each of the cathodes is on the time that the display is on is in turn shortened to dim the display. Alternately, the amount of current directed to the device can be reduced to decrease the intensity of the bar graph. The present bar graph, having a dimming capability to provide comfortable operation in a low ambient light region, avoids the problems with night vision.

DETAILED DESCRIPTION OF THE INVENTION

Figure 1:
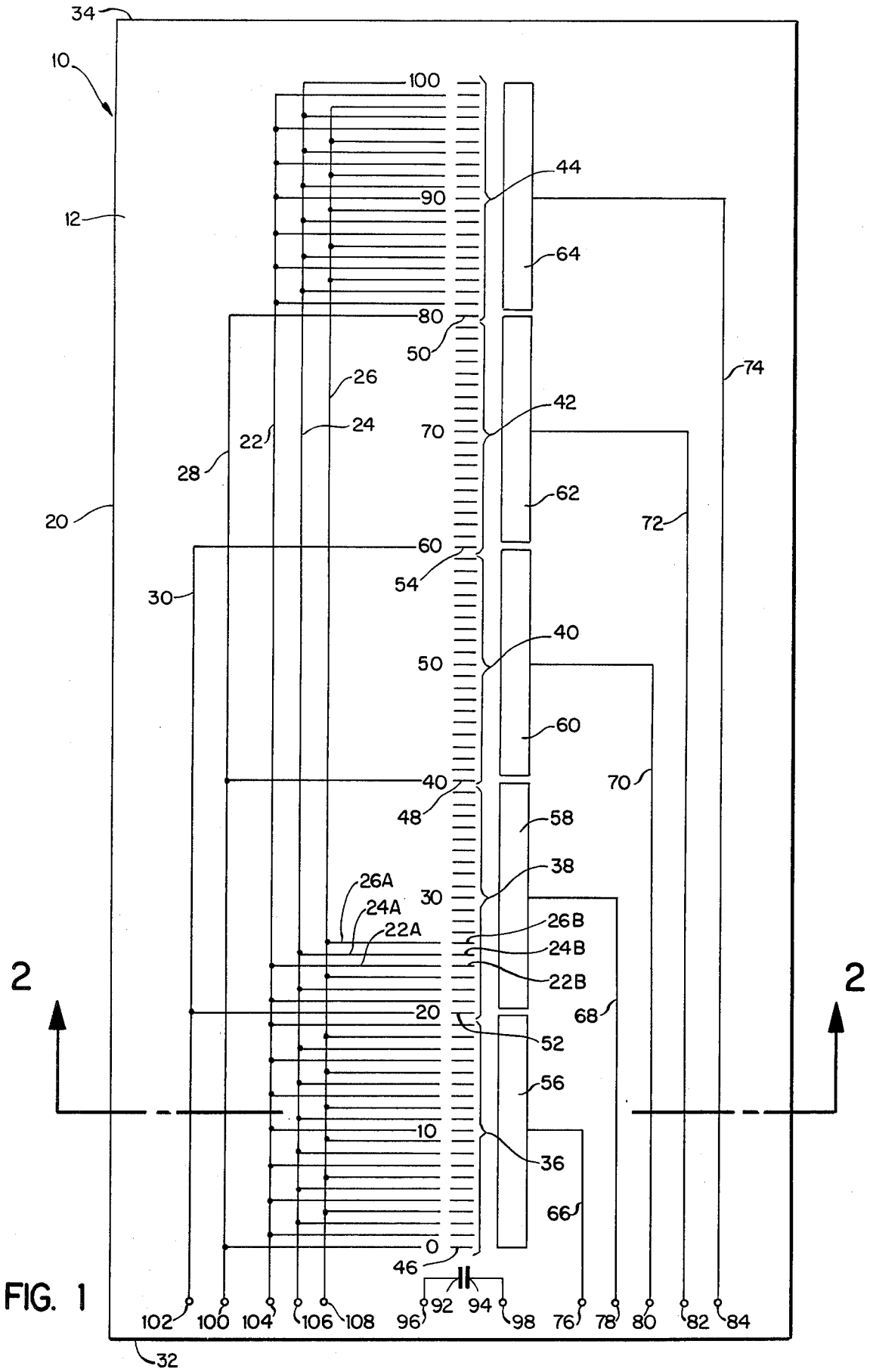
FIG. 1 is a schematic plan view of the present bar graph invention.
Figure 2:
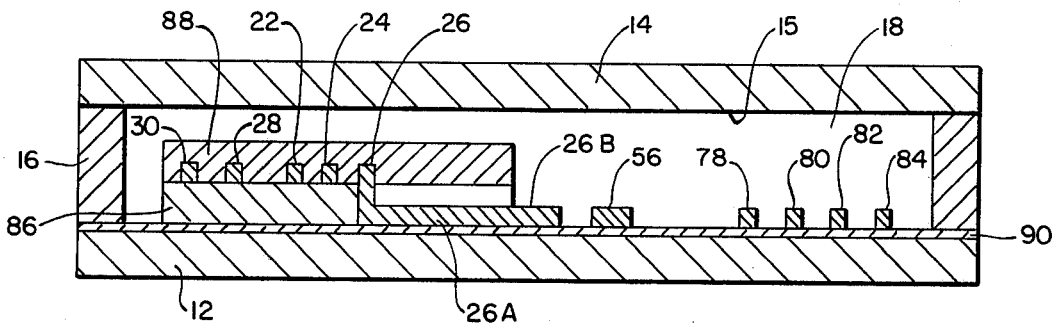
FIG. 2 is a detailed sectional view of the bar graph display taken along the lines 2—2 in FIG. 1.

The gas discharge display bar graph 10 of the present invention is shown in FIGS. 1 and 2 having a substrate 12 to which is sealed a face plate in spaced relation with a viewing window. The substrate 12 and face plate 14 are sealed together using a glass frit and spacer material 16. This arrangement forms a sealed envelope 18 which receives an ionizable gas. Positioned adjacent one side 20 of the substrate 12 in FIG. 1 are three cathode phase lines 22, 24 and 26. Located between the cathode phase lines and the one side 20 of the substrate 12 are two cathode reset lines 28 and 30. Connected to each of the respective cathode phase lines 22, 24 and 26 are a plurality of respective cathode electrode lines 22A, 24A and 26A which are alternately placed with respect to each other along the length of the substrate 12 from the bottom edge 32 of the substrate to its top edge 34. The respective ends 22B, 24B and 26B of the cathode electrode lines 22A, 24A and 26A constitute the cathode electrodes which exhibits a glow discharge. Each cathode electrode line 22A is connected to cathode phase line 22 while each cathode electrode line 24A is connected to cathode phase line 24. Similarly, each cathode electrode line 26A is connected to cathode phase line 26.

The arrangement of cathodes set forth in FIG. 1 is in the form of a column with a scale of 0 to 100 with each unit value on the scale corresponding to one of the cathodes, respectively, which alternate throughout the column of the overall display device. The cathode electrodes are arranged into five separate groups 36, 38, 40, 42 and 44 of 20 electrodes in each group with the exception of the last or highest group 44 which has twenty-one electrodes. The respective groups of cathode electrodes 36, 38, 40, 42 and 44 are successively placed along the substrate 12 in column form adjacent each other to form the one continuous bar of alternate cathode segments 22B, 24B and 26B. Attached to the first reset cathode line 28 is the reset cathode electrode 46 adjacent the first cathode electrode 22B in group 36. Also connected to the first reset cathode line 28 is the reset cathode electrode 48 in the third cathode electrode group 40 as well as the reset cathode electrode 50 in the fifth cathode electrode group 44. Similarly, connected to the second cathode electrode reset line 30 is the reset cathode electrode 52 in the second cathode electrode group 38 and the reset cathode electrode 54 in the fourth cathode electrode group 42.

Located adjacent the respective cathode electrode groups 36, 38, 40 and 44 are respective coplanar anodes 56, 58, 60, 62 and 64. It should be noted that these anodes could be in the form of transparent thin anodes on the lower surface 15 of the face plate 14. Connected to the respective anode electrodes are separate anode control lines 66, 68, 70, 72 and 74. These lines terminate into respective contact pads 76, 78, 80, 82 and 84 which are located outside the sealed envelope 18 of the display device 10 adjacent the bottom edge 32 of the substrate 12.

As shown more clearly in FIG. 2, the visible cathode segment 26B is shown connected to the cathode electrode line 26A. The cathode phase line 26 is connected to the cathode electrode line 26A. The respective cathode reset lines 28 and 30 as well as the cathode electrode phase lines 22, 24 and 26 are insulated from each other by insulating layers 86. The cathode electrode lines 22A, 24A and 26A as well as the cathode phase lines 22, 24 and 26 and the cathode reset lines 28 and 30 are covered with insulating material 88 to insulate them from the electric field within the sealed envelope 18 to prevent a gas discharge from being exhibited adjacent them. The anode electrode 56 shown in FIG. 2 is located adjacent the cathode electrode 26B with the anode electrode lead lines 78, 80, 82 and 84 in spaced relation adjacent the cathode electrode 56. Typically, a dark dielectric mask 90 is positioned over the substrate 12 to provide a better contrasting background to the cathode electrodes exhibiting glow discharge.

Positioned adjacent the reset cathode electrode 46 in the first cathode electrode group 36 are a keep-alive cathode 92 and anode 94 to provide a constant source of ionizable gas to allow for the initiation of the propagation of the glow discharge. The termination pads 96 and 98 of the keep-alive cathode and anode are designed to be in contact with a constant source of power to retain the operation of the keep-alive anode and cathode.

The cathode reset lines 28 and 30 terminate into contact pads 100 and 102, respectively. Each of the cathode electrode phase lines 22, 24 and 26 terminates at one of the respective contact pads 104, 106 and 108 outside of the sealed envelope 18 adjacent the first edge 32 of the substrate 12. However, the contact pads could be located along either side or edge of the substrate if desired.

Turning to the operation of the present invention, attention is directed to FIG. 1 where power is supplied to the keep-alive terminals 96 and 98 to initiate a gas discharge adjacent the keep-alive cathode 92 and anode 94. This provides a source of ionizable gas adjacent the reset cathode electrode 46 in the first cathode group 36. The present device operates on the principle of glow transfer similar to that utilized in prior art arrangements wherein power is supplied to the first cathode electrode reset line 28 to activate the reset cathode electrode 46 in the group 36 which in conjunction with activation of the anode 56 will allow for the propagation of the glow transfer from the keep-alive anode 94 and cathode 92 to the reset cathode electrode 46. The respective cathode electrode lines 22A, 24A and 26A are alternately energized to allow for the propagation of the glow transfer along the first group of cathode electrodes 36.

The basic overall principle of operation of the present invention is to simultaneously activate alternate ones of the anodes 56, 60 and 64 followed by the simultaneous activation of anodes 58 and 62. Therefore, the anodes 56, 60 and 64 are on one half of the time frame that is required if a glow would be propagated from the zero indicator mark on the bar graph to the one hundred indicator mark. This is shown in the timing diagram of FIG. 3. During the second half of the time frame anodes 58 and 62 would be one. The alternating timed sequence between the activation of the alternate cathode electrode lines 22, 24 and 26 and the anodes occurs in such a manner and in a set time frame to allow the glow to propagate from the zero indicator mark to the one hundred indicator mark.

If the display had only a single anode for all the cathode segments, the on time or the glow period for each cathode electrode for each time frame would be one one hundredth of the overall time frame necessary to propagate the glow the entire length of the bar. In the present invention the on time or glow period for each of the respective cathode electrode segments is increased to increase the intensity of the bar graph. This is accomplished by having alternate ones of the anodes activated for one half of the time frame, so that during one half of the time frame the cathode electrodes in group 36, 40 and 44, if a complete bar graph were to be exhibited, would be on a period of time greater than one hundredth of the time frame. Similarly, corresponding cathode electrodes in group 38 and 42 would be on the same increased period of time.

In order to avoid having possible cross talk or streaming between the last cathode electrode 22B in the first cathode electrode group 36 and the anode electrode 58 adjacent the second group of cathodes 38, a reset cathode 52 in cathode group 38 is positioned adjacent the last cathode segment 22B and operates on a separate power source than the cathode electrode phase lines. The reset cathode 52 increases the distance sufficiently between the adjacent anode 58 and the last cathode 22B in the adjacent cathode group 36 to prevent possible unwanted ignition of that adjacent cathode 22B by the anode 58. The use of the reset cathodes 52, 48, 54 and 50 are necessary in order to provide continuity of the cathode spacing, so that the bar will appear as a continuous line with no gap showing when it is operating.

Figure 4:
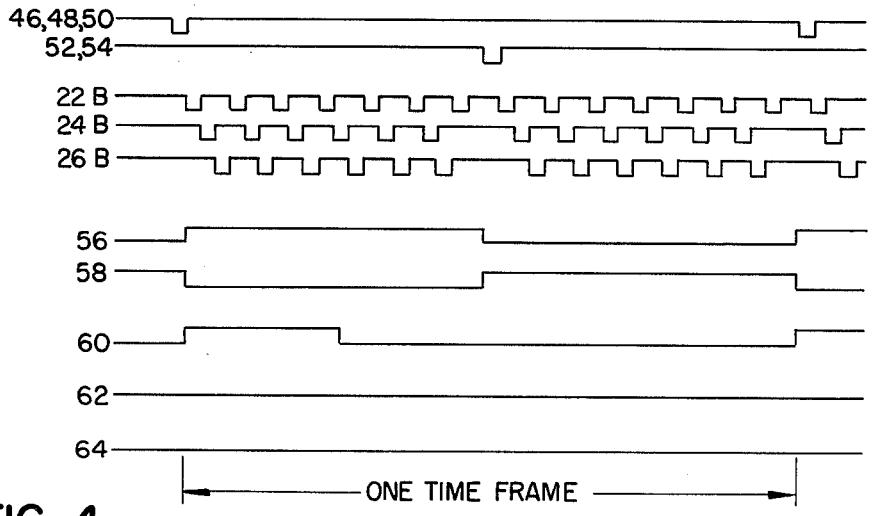
FIG. 4 is a time diagram showing the operation of the present invention to light half of the display.

To more particularly explain the operation of the present invention, an example will be discussed where a value of fifty is to be displayed on the bar graph. It is to be assumed that the time frame for one scan of the cathode segments along the entire display takes 12 milliseconds and is continuously repeated to provide a solid bar of light with no visible flicker to the human eye. The present discussion will describe what occurs step by step in the operation of the bar graph to show a value of 50. After the keep-alive anode 94 and cathode 92 are energized to provide a source of ionizable gas, the first reset line 28 is activated to operate the reset cathode electrode 46 in cathode electrode group 36 and the reset cathode electrode 48 in cathode electrode group 40. Similarly, the reset cathode electrode 50 in cathode electrode group 44 is activated. During the first half cycle or first half of the time frame as shown in FIG. 4 anodes 56 and 60 are activated while anode 64 is not activated. Anode 60 is activated for a time period shorter than one half the time frame proportional to the value of 50 to be shown on the bar graph. The overall control of the height of the bar graph is by the operation of anodes. The time period of activation of the anodes is in response to an input data signal.

With the activation of the first anode 56 in conjunction with the alternating activation of the cathode electrode lines 22, 24 and 26 the glow will propagate up the first group of cathode electrodes 36 during the first half of the time frame while the anode 56 is on. Similarly, the glow will transfer in the third cathode electrode group 40 from the reset cathode electrode 48 up to the limit of fifty on the scale which is controlled by the time that the anode electrode 60 is allowed to be on in response to the input signal. Therefore, when the glow transfer has reached the cathode electrode 22B adjacent the scale designation of fifty, the anode 60 will turn off to extinguish the glow. It will be turned on again to initiate the glow at cathode electrode 48 whereupon it will be sequenced again to the value of fifty during the first half of the next time frame cycle.

During the second half of the time frame the cathode electrode reset line 30 is activated to activate the reset cathode electrode 52 in cathode group 38 and reset cathode electrode 54 in group 42. Since anode 62 is not activated, there will be no glow adjacent the first cathode electrode 54 in cathode group 42. However, anode 58 is activated and glow will transfer from the reset cathode electrode 52 in group 38 along each of the cathode electrodes successively until the last cathode electrode 22B which is adjacent the scale value of 39 is reached. No other glow transfer will occur during the second half of the time frame, since the anode 62 is not activated.

Therefore, since the overall time frame used is twelve milliseconds which is above the flicker rate visible to the eye, the combined operation of the scanning of the respective cathode groups 36 and 40 during the first half of the time frame and the cathode electrode group 38 in the second half of the time frame will appear as one continuous bar of glow from zero to the value of 50 on the scale of the bar.

If only one anode were used adjacent the entire column of cathode electrodes from the 0 to the 100 value on the scale as is the case with respect to prior art in the cited U.S. Pat. No. 3,973,166, the time on for each of the cathode electrodes would be one one hundredth of the total time frame. In the case of a twelve milliseconds time frame, the total time on for each of the cathode electrodes would be 120 microseconds. With respect to the present invention of having five cathode electrode groups with five adjacent anodes and alternate ones of anodes being operating simultaneously during one half of the time frame, the total time on for each cathode electrode segment would be one half of the 12 milliseconds divided by the number of cathode segments in each group. In the present invention each cathode group has twenty cathode segments so that the on time for each cathode segment is 300 microseconds.

Although the present discussion has been directed to having twenty cathode segments in each cathode group, it should be noted that each cathode group could have any number of cathodes depending upon the performance requirements of the device.

Dimming can be accomplished by either decreasing the current supplied to the anode and cathodes or by increasing the cycling time of the alternate sets of anodes during the time frame so that the rest of the time in the time frame is allocated to an off period to reduce the total time each cathode electrode is subjected to a glow discharge.

The fact that the cycling time of the anodes can be varied to control the amount of time that the cathode electrodes are on to exhibit glow discharge provides the capability to develop various formats in the present bar graph invention. Rather than being utilized as a high intensity bar graph, the operation of the anodes can be arranged such that the anode electrodes could operate to show a moving band of light which has a fixed length that moves up and down the entire column in response to an input data signal. The present invention's use of the unique multiple anode control provides more available time in the time frame to establish limit points on the bar graph for an operator to use in reference to a moving mark. The time used to provide greater intensity on cathodes can be used for intensity modulation with a dimming range to run a span with a line or marker of light. In a single anode bar graph there is no time available for the use of forming marker points, etc., in the bar graph format, because any additional time used on a single anode bar graph would result in the dimming of the bar to the point that it would not present a viable display device.

Although it appears that more than one keep-alive cathode 92 and anode 94 arrangement shown adjacent the first cathodes 46 in the first cathode group 36 would be needed adjacent the first cathode electrode in each of the cathode electrode groups, it has been found that the single keep-alive anode and cathode is sufficient to provide ionizable gas throughout the sealed envelope to allow for the initiation of a glow discharge adjacent the reset cathode in each of the cathode groups when they are activated by their respective cathode reset lines and their adjacent anode electrode. It has been found, however, that a boost voltage in these cathode reset lines does increase the efficiency of the operation.

Figure 3:
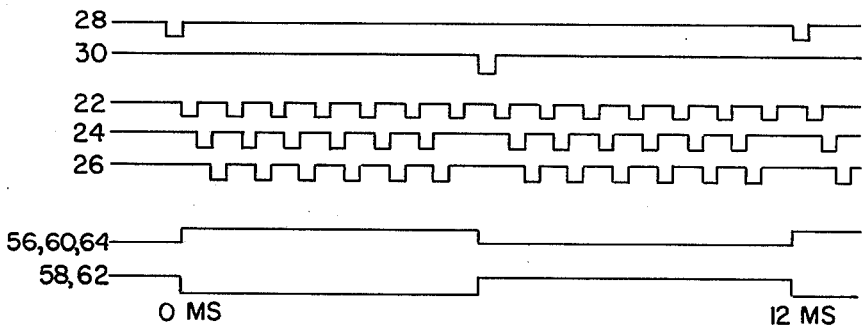
FIG. 3 is a time diagram showing the operation of the present invention to light the entire display.

In FIG. 3 a timing diagram is shown which sets forth the relationship between the operation of the respective anodes and the cathode reset lines as well as the cathode phase lines. In the case of where the entire bar is to be lit, it can be seen from FIG. 3 that during one half of the 12 millisecond time frame the anodes 56, 60 and 64 are activated to operate for one half of the time frame in conjunction with the alternating activation of the cathode phase lines 22, 24 and 26. Further, it should be noted that the cathode reset line 28 is activated at the beginning of the time frame to initiate the cathode glow to be propagated along the respective groups of cathode electrodes 36, 40, and 44. During the second half of the time frame anodes 56, 60 and 64 are turned off and anodes 58 and 62 are activated in conjunction with cathode electrode phase lines 22, 24 and 26. Also it should be noted that the cathode reset line 30 is activated to initiate glow discharge adjacent the first cathode electrode in the cathode electrode groups 38 and 42. In this one half of the time frame the glow discharge will propagate throughout the cathode electrodes in each of the alternate groups of cathode electrodes 38 and 42. When the complete time frame of 12 milliseconds is completed, all the cathode electrodes have been ignited and have exhibited glow discharge. The length of time upon which each of the cathode electrodes has exhibited glow discharge is as previously indicated one half of the total time frame divided by the number of cathode electrodes in the respective cathode electrode groups.

Although the present invention has thus far been discussed showing a single bar on one substrate, it should be understood that two or more bars could be displayed on a single substrate with the respective cathode electrode lines 22A, 24A and 26A extended sufficiently across the substrate with two or more exposed portions of these cathode electrode lines. However, it is necessary to have separate anode electrodes adjacent each column of visible cathode electrode segments to control separately the magnitude and variation of the height of the glow discharge on each respective column on the substrate.

Figure 5:
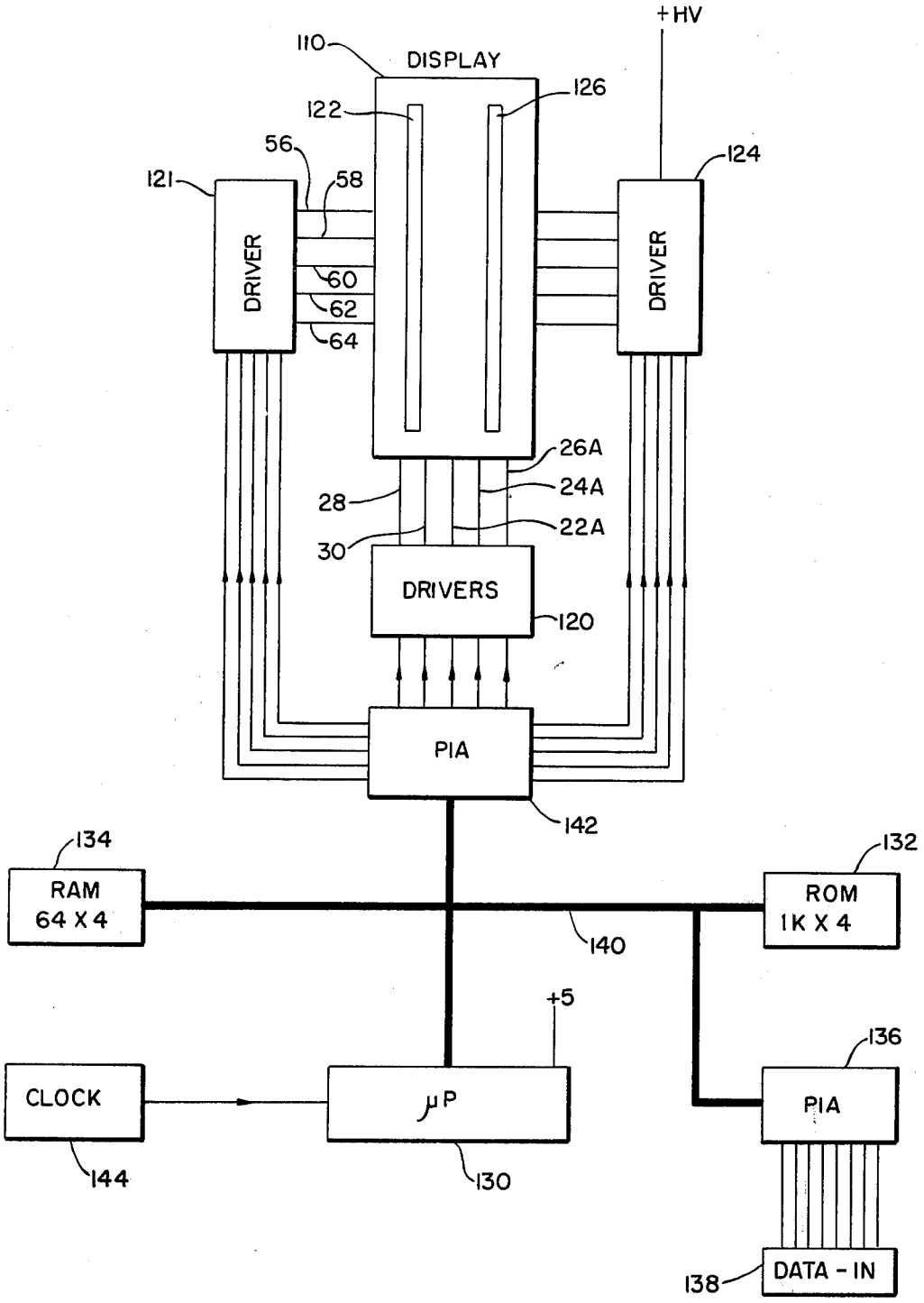
FIG. 5 is a schematic view of the overall bar graph display with the components utilized to operate it.

FIG. 5 shows a schematic circuit arrangement for operating a dual bar graph display 110 wherein two separately operated independently controlled columns of light 122 and 126 can be shown on a single substrate display. Since the figure is schematic, the location of the lead lines from the respective circuitry parts are not necessarily connected to the edge of the bar graph display as shown.

In order to supply power to the respective cathode electrode phase lines 22A, 24A and 26A, a series of drivers 120 are connected to these lines. Furthermore, the cathode reset lines 28 and 30 are connected to drivers 120 to provide power to these lines. Drivers 121 are connected to the respective anodes 56, 58, 60, 62 and 64. These anodes operate the first bar 122 of the display 110 while the driver 124 is connected to five respective anodes which are in operative relatonship with the second display column 126. The overall control of the device for programming the proper operation of the bar graph display in response to an input data signal is a microprocessor 130. Connected to the microprocessor is a ROM (read only memory) 132 that contains the program needed to operate the microprocessor 130 and its associated electronics. A RAM (random access memory) 134 is used to store input information and certain program variables. A first PIA (parallel interface adaptor) 136 presents input data 138 to the microprocessor data bus 140 or take the data 138 and store it. A second PIA 142 outputs the data 138 from the data bus 140 to operate the anode drivers 121 and 124 as well as the cathode drivers 120. A clock circuit 144 provides timing signals for the microprocessor 130.

As those skilled in the field of microprocessors are aware, under present technology the clock 144, microprocessor 130, RAM 134, ROM 132 and the two PIA's 136 and 142 functions can all be included on a single integrated circuit package such as the Intel 8048 or Mostek 3870 microcomputer chips. In using a system incorporating the 8048 series microcomputer, pulses, as shown in FIG. 3, are generated for the respective anodes and cathodes. The program stored in the ROM 132 in conjunction with the microprocessor 130 will accept and store input data as well as select appropriate anodes to turn on or off during operation of the respective display columns 122 and 126. The microprocessor program will perform the needed counting and timing functions in addition to adjusting the cathode on time and duty cycle to allow adjustment of a perceived display brightness.

Those skilled in the field of microprocessors will readily recognize that by adding more programs to the ROM 132 the device could be programmed for such other various features as self test, intensification, blinking bars, analog-to-digital conversion and nonlinear curves.

What is claimed is:

1. A gas discharge analog display comprising:

a substrate;

a faceplate sealed in spaced relation to said substrate to form a sealed envelope;

an ionizable gas within said envelope;

a plurality of groups of linear cathode electrodes mounted on said substrate within said envelope in succession along said substrate to form a column, each of said groups having X cathode electrodes;

means for initiating a glow discharge adjacent the first cathode electrode in each of said groups;

means for propagating a glow discharge along said cathode electrodes one by one sequentially in each of said groups, each of said cathode electrodes exhibiting a glow discharge only when it is adjacent a glowing cathode electrode, said glow discharge being able to propagate along the entire length of said column in one time frame;

a plurality of anode electrodes with each of said anode electrodes being in operative relation with each of said plurality of groups of cathodes; and means operating in conjunction with said propagating means for activating each of said anode electrodes for one half of said time frame so that the duration of said glow discharge on each of said cathode electrodes will be said one half time frame divided by said X number of cathode electrodes.

2. A gas discharge analog display as defined in claim 1 and additionally comprising means for controlling said anode electrode activating means in response to an input data signal, the length of said glow discharge along said column being in direct relation to the time duration of said signal, said time duration of said signal being at least a portion of said time frame, said signal causing a glow discharge of at least one of said cathode electrodes in at least one of said groups of cathode electrodes.

3. A gas discharge analog display as defined in claim 1 wherein said plurality of groups of cathode electrodes comprises at least three groups of cathode electrodes, and wherein said plurality of anode electrodes comprises at least three anodes, said anode electrode activating means operating alternate ones of each of said anode electrodes simultaneously so that corresponding cathode electrodes in said groups in operating relation to said alternate anode electrodes will exhibit a glow discharge simultaneously to produce a high intensity bar graph display.

4. A variable brightness gas discharge analog display comprising:

a sealed envelope having a viewing window and a support substrate opposite said window;

an ionizable gas within said envelope;

at least two groups of cathode electrodes located on said substrate arranged in succession to form a continuous column;

means connected to each of said cathode electrodes in said plurality of groups of cathode electrodes for energizing each of said cathode electrodes in succession along said column to propagate a glow discharge along said column, said glow forming on one of said cathode electrodes only when said one cathode electrode is adjacent a glowing cathode electrode to form a viewable continuous bar of glow;

at least two anode electrodes, each being in operative relation to each of said groups of cathode electrodes;

means for activating alternate ones of said anode electrodes simultaneously, said anode electrode activating means being responsive to an input data signal, the length of said bar of glow being dependent on the information of said input data signal; and means located between the last cathode electrode of each successive group of cathode electrodes and the first cathode electrode of each successive group of cathode electrodes for preventing said first cathode electrode from forming a glow discharge in conjunction with the anode electrode adjacent the preceding group of cathode electrodes.

5. A variable brightness gas discharge analog display as defined in claim 4 wherein said preventing means comprises a series of reset cathodes, each being located adjacent the first cathode electrode in each of said groups of cathode electrodes.

6. A variable brightness gas discharge analog display as defined in claim 5 and additionally comprising at least two reset cathode circuits with alternate ones of said reset cathodes being connected to each respective reset cathode circuit and means for applying an electrical field to said first cathode electrode in each alternate group of cathodes in alternating sequence, so that corresponding cathode electrodes in each of said alternate groups of cathode electrodes exhibits a glow discharge simultaneously to produce a high intensity bar graph.

7. A variable brightness gas discharge analog display comprising:

a substrate;

a face plate sealed to said substrate in spaced relation to form a sealed envelope;

an ionizable gas within said envelope;

a plurality of groups of linear cathode electrodes located on said substrate and arranged in succession to form a column;

means adjacent the first of said cathode electrodes in each of said groups for initiating a glow discharge;

means connected to said cathode electrodes in each of said groups for propagating said glow discharge along said cathode electrodes one by one sequentially in each of said groups, each of said cathode electrodes exhibiting a glow discharge only when it is adjacent a glowing cathode electrode, the glow cf each of said cathode electrodes in sequence in said groups in combination forming a viewable continuous bar of glow;

a separate anode electrode located in operative relation to each of said plurality of groups of cathode electrodes; and means for activating each of said anode electrodes, said activating means operating alternate anodes simultaneously.

8. A variable brightness gas discharge analog display as defined in claim 7, wherein said means for propagating said glow discharge comprises:

at least two cathode circuits with alternate ones of said cathode electrodes of said column being interconnected to one of said circuits; and means for applying an electrical field to said circuits sequentially.

9. A variable brightness gas discharge analog display as defined in claim 8 and additionally comprising means for scanning each of said groups of cathode electrode in repeating sequence to establish said bar of glow.

* * * * *